US011794497B2

(12) United States Patent
Hirsch et al.

(10) Patent No.: US 11,794,497 B2
(45) Date of Patent: Oct. 24, 2023

(54) LABEL PRINTER

(71) Applicant: Bizerba SE & Co. KG, Balingen (DE)

(72) Inventors: Alexander Hirsch, Stuttgart (DE); Joerg Haigis, Balingen (DE)

(73) Assignee: Bizerba SE & Co. KG, Balingen (DE)

( * ) Notice: Subject to any disclaimer, the term of this patent is extended or adjusted under 35 U.S.C. 154(b) by 134 days.

(21) Appl. No.: 17/459,777

(22) Filed: Aug. 27, 2021

(65) Prior Publication Data

US 2022/0080755 A1 Mar. 17, 2022

(30) Foreign Application Priority Data

Sep. 11, 2020 (EP) ..... 20195723

(51) Int. Cl.
*B41J 11/70* (2006.01)
*B41J 3/407* (2006.01)

(52) U.S. Cl.
CPC ..... *B41J 11/70* (2013.01); *B41J 3/4075* (2013.01)

(58) Field of Classification Search
CPC . B41J 13/106; B41J 13/18; B41J 15/00; B41J 15/044; B41J 17/18; B41J 17/20; B41J 11/04; B41J 11/70; B41J 3/4075; B65C 11/0289
See application file for complete search history.

(56) References Cited

U.S. PATENT DOCUMENTS 5,560,293 A * 10/1996 Boreali ..... B41J 2/32 400/621
6,651,537 B1 11/2003 Pfeiffer
7,186,043 B2 3/2007 Keller
9,604,474 B2 3/2017 Murata
2008/0095565 A1 4/2008 Ray
2011/0146912 A1* 6/2011 Howarth ..... B65C 9/1876 40/675
2016/0136964 A1* 5/2016 Howarth ..... B65C 9/1884 347/197
2019/0202654 A1 7/2019 Dehner et al.

FOREIGN PATENT DOCUMENTS

DE 199 58 274 A1 6/2001
DE 10 2009 014 992 A1 9/2010
EP 3 505 355 A1 7/2019

OTHER PUBLICATIONS

European Search Report dated Jan. 18, 2021 in related European Patent Application No. 20195723.0 (three pages).

* cited by examiner

*Primary Examiner* — Kristal Feggins

(74) *Attorney, Agent, or Firm* — Kilpatrick Townsend & Stockton LLP

(57) ABSTRACT

The invention relates to a label printer for printing self-adhesive linerless endless tape labels, said label printer comprising a printhead and a driven print roller, wherein the endless tape labels can be led along a label track between the printhead and the print roller; and a stripping element for stripping off the labels from the print roller, said stripping element being connected downstream of the print roller in a transport direction of the endless tape labels, wherein the print roller is replaceably inserted into a print roller receiver of the label printer and is captively held in the print roller receiver by the stripping element.

21 Claims, 8 Drawing Sheets

LABEL PRINTER

Figure 1:
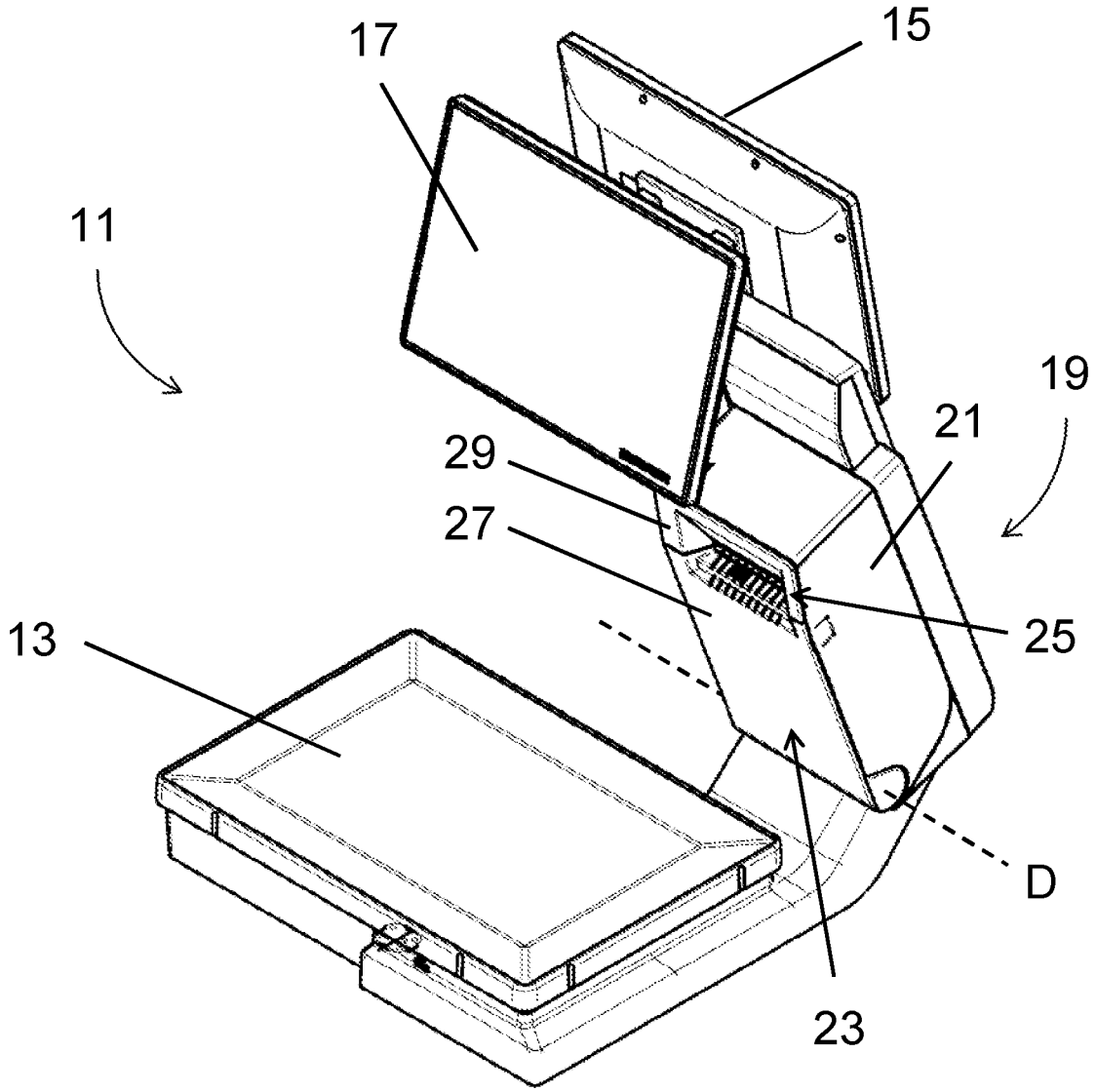

This application claims priority to European Patent Application 20195723.0 filed Sep. 11, 2020, the disclosure of which is incorporated by reference herein.

The invention relates to a label printer for printing self-adhesive linerless endless tape labels, said label printer comprising a printhead and a driven print roller, wherein the endless tape labels can be led along a label track between the printhead and the print roller; and a stripping element for stripping off the labels from the print roller, said stripping element being connected downstream of the print roller in a transport direction of the endless tape labels.

Such a label printer is known from document DE 10 2009 014 992 A1. The stripping element is arranged behind the print roller and directly adjoining the print roller, viewed in the transport direction of the endless tape labels. The stripping element is provided to strip off the self-adhesive linerless endless tape labels, which are also designated as linerless labels, from the print roller or to ensure that the labels do not adhere to the print roller with their adhesive-coated lower sides. Behind the stripping element, the respective printed label is then separated from the endless tape labels by means of a cutter, such as is known from document DE 199 58 274 A1, or a tear-off edge. The stripping element is in particular necessary when the respective next label has in this respect already partly passed through the print region between the printhead and the print roller and the labels should also be printed in the part region that has already been passed through. The endless tape labels are then at least approximately retracted (reversing) up to the label start of the next label at which the preceding label was cut off, wherein an adhesion of the endless tape start to the print roller can be prevented by the stripping element.

The print roller is a wear part that, during the service life of the label printer, has to be replaced once or multiple times under certain circumstances. However, the replacement of the print roller is complex and/or expensive and can often only be carried out by a service technician.

It is the underlying object of the invention to provide a label printer of the initially named kind that enables a simple replacement of the print roller.

This object is satisfied by a label printer having the features of independent claim 1, and in particular in that the print roller is inserted into a print roller receiver of the label printer and is captively held in the print roller receiver by the stripping element.

In accordance with the invention, the print roller is therefore not installed in a complicated manner in the label printer, but it is merely necessary to insert the print roller into a print roller receiver and then to captively hold it in the inserted position by stripping element that is the anyway present. The replacement of the print roller can then also take place by an untrained operator.

In accordance with a preferred embodiment of the invention, the label printer comprises a cutter for separating the endless tape labels, said cutter being connected downstream of the stripping element in the transport direction of the endless tape labels and comprising a transport roller and a blade unit travelable in a linear manner in parallel with an axis of rotation of the transport roller, with the endless tape labels being able to be led between the transport roller and the blade unit, and with the transport roller of the cutter being supported at the stripping element. The transport roller serves as a counter holder for a cutting blade of the blade unit in this respect. A compact design can be achieved by the support of the transport roller of the cutter directly at the stripping element. The spacing between the print roller and the transport roller of the cutter can in particular be kept small so that any reversing of the endless tape labels can be kept to a minimum and can be completely avoided under certain circumstances, whereby the printing speed of the label printer can be increased.

To support the cutter at the stripping element, the stripping element can comprise an elongated stripping section whose longitudinal extent extends in parallel with the axis of rotation of the print roller and which, at its two ends disposed in the direction of the axis of rotation of the print roller, has a respective reception section, in particular having a respective edge-side recess, for the two axial ends of the transport roller of the cutter. The transport roller can then be easily inserted into the two reception sections, in particular the two edge-side recesses.

Provision can in this respect be made that the respective axial end of the transport roller is secured in the respective recess of the respective reception section of the stripping element by a respective axially inserted bearing sleeve. Alternatively, provision can also be made that the respective axial end of the transport roller is inserted into the respective recess of the respective reception section of the stripping element while forming a respective snap-in connection. In both cases, the transport roller can be supported at the stripping element in a particularly simple manner.

In accordance with a preferred embodiment of the invention, the label printer comprises a housing casing; and a housing element, in particular a door, that is attached to an open side of the housing casing and that can be folded about a pivot axis between a closed position and an open position, wherein the printhead and in particular the aforesaid blade unit is, in particular are, attached in the housing casing and the print roller and the stripping element, and in particular the aforesaid transport roller, are attached to the foldable housing element. In the open position, the print roller with the foldable housing element is pivoted out of the housing casing and is thus particularly easily accessible for a replacement.

In the closed position of the foldable housing element, the print roller can in particular be fixedly secured in the label printer by a securing device that is arranged in the housing casing and that becomes effective on the closing of the foldable housing element. This is in particular advantageous when the captive holding of the print roller in the print roller receiver by the stripping element is subject to play.

The foldable housing element can in particular comprise two mutually oppositely disposed side cheeks which, with their respective first ends, are connected in an articulated manner to a respective side wall of the housing, which extend into the housing casing in the closed position of the foldable housing element, and at which, in particular at their respective second ends, the print roller receiver is formed, in particular in the form of a respective edge-side recess for the two axial ends of the print roller. A simple and stable support of the print roller can hereby be achieved. The print roller can in particular be easily inserted into the two edge-side recesses. In this case, the aforementioned safety device can, for example, comprise two abutments which, at the end of the closing of the foldable housing element, press against the two axial ends of the print roller pivoting into the housing casing.

The print roller is preferably supported indirectly via a bearing element, in particular a bearing sleeve, at each of its two axial ends in the print roller receiver. The support surface for the two axial ends of the print roller can be increased by the two bearing elements. Furthermore, the technical flexibility in the support of the print roller can be increased. For example, the respective bearing element can be acted on by a spring force, e.g. as explained in the following, without influencing the rotational movement of the print roller in so doing.

The two side cheeks can be connected to one another via a transverse strut. In this respect, it is preferred if the stripping element is attached to the transverse strut of the foldable housing element. A particularly simple and simultaneously particularly stable design is hereby achieved.

The print roller can in particular be removable from the print roller receiver and insertable into the print roller receiver at an angle in the range from 60° to 120° with respect to the label track. In this angular range, the captive holding of the print roller in the print roller receiver can be particularly easily implemented by the stripping element.

The stripping element and the print roller can have an overlap in the range from 0.3 mm to 3 mm, preferably from 0.3 mm to 2 mm, in a projection onto the label track. The stripping function of the stripping element can hereby also be guaranteed at all times during the aforementioned reversing of the endless tape labels. The direct or nearest spacing between the stripping element and the print roller can be in the range from 0.5 mm to 3 mm, for example. The diameter of the print roller can, for example, amount to a value in the range from 10 mm to 35 mm.

In accordance with an embodiment of the invention, the print roller is produced from an elastically deformable material, in particular silicone, and can be forced in a non-destructive manner past the stripping element out of the print roller receiver and into the print roller receiver while forming an elastic deformation. The force effort required for this purpose can be set via the aforementioned overlap. This design is particularly inexpensive. No further holding means are required to hold the print roller in the print roller receiver.

In accordance with a further embodiment of the invention, the print roller is displaceably supported, in particular by means of an elongate hole arrangement and/or transversely to a removal direction of the print roller, between an operating position, in which the print roller is captively held in the print roller receiver by the stripping element and into which the print roller is preloaded by means of a spring device, and a removal position in which the print roller can be removed from the print roller receiver without resistance by the stripping element. In this design, only a small amount of force is required to overcome the preload of the spring device in order to displace the print roller into the removal position.

In accordance with another embodiment of the invention, the stripping element is releasably fastened in the label printer, with the print roller being removable from the print roller receiver without resistance by the stripping element after the release, in particular the unscrewing, of the stripping element. This design is indeed more complex, but intuitive for the operator.

The print roller can preferably be removed from the print roller receiver and inserted into the print roller receiver without tools, in particular as described in the above embodiments. The replacement of the print roller can thus take place in a particularly simple and comfortable manner.

The invention furthermore relates to a scale, in particular to a store scale, having a label printer as described above.

Further advantageous embodiments of the invention are described in the dependent claims, in the description of the Figures, and in the drawing.

Figure 2:
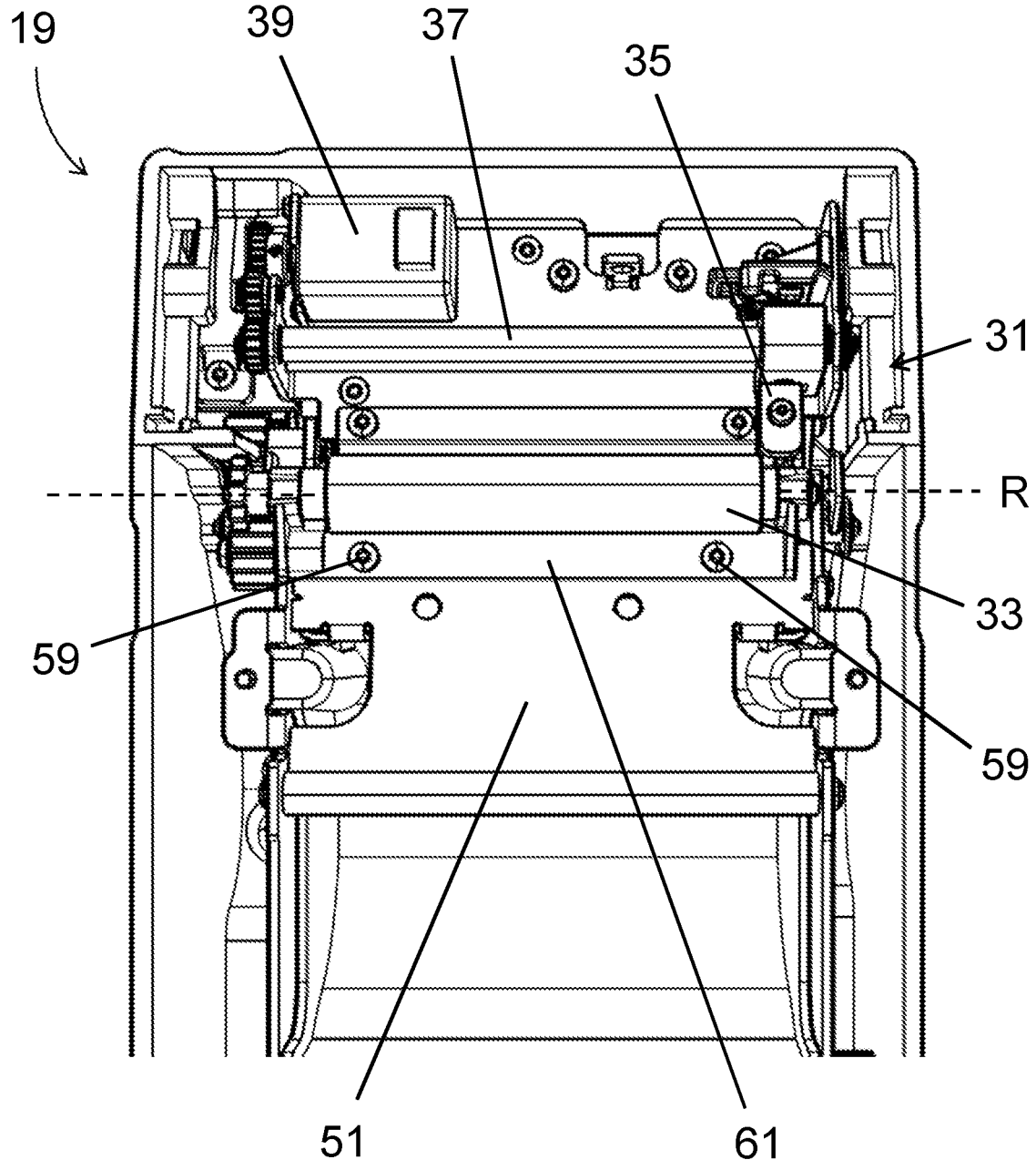
Figure 3:
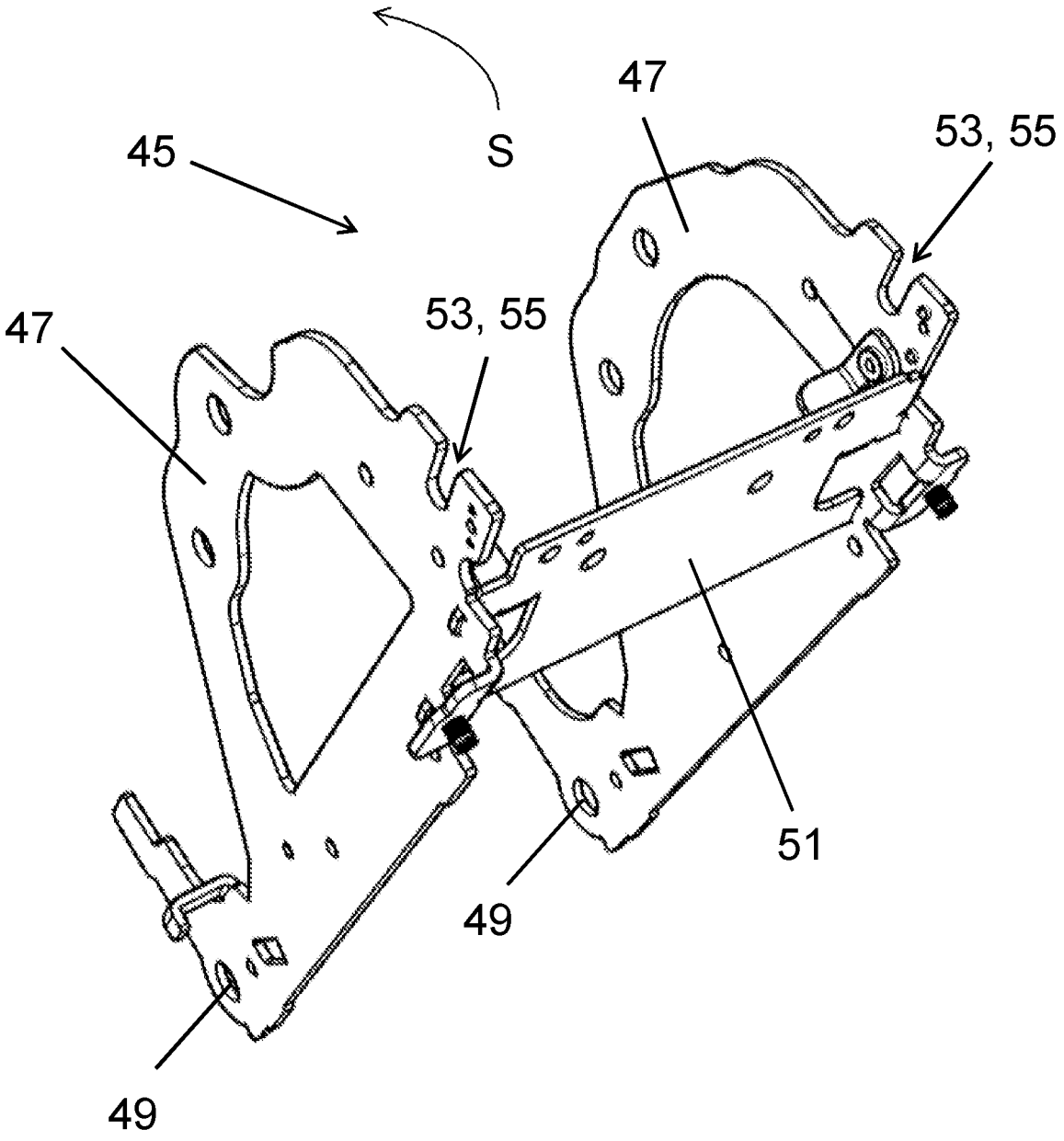
Figure 4:
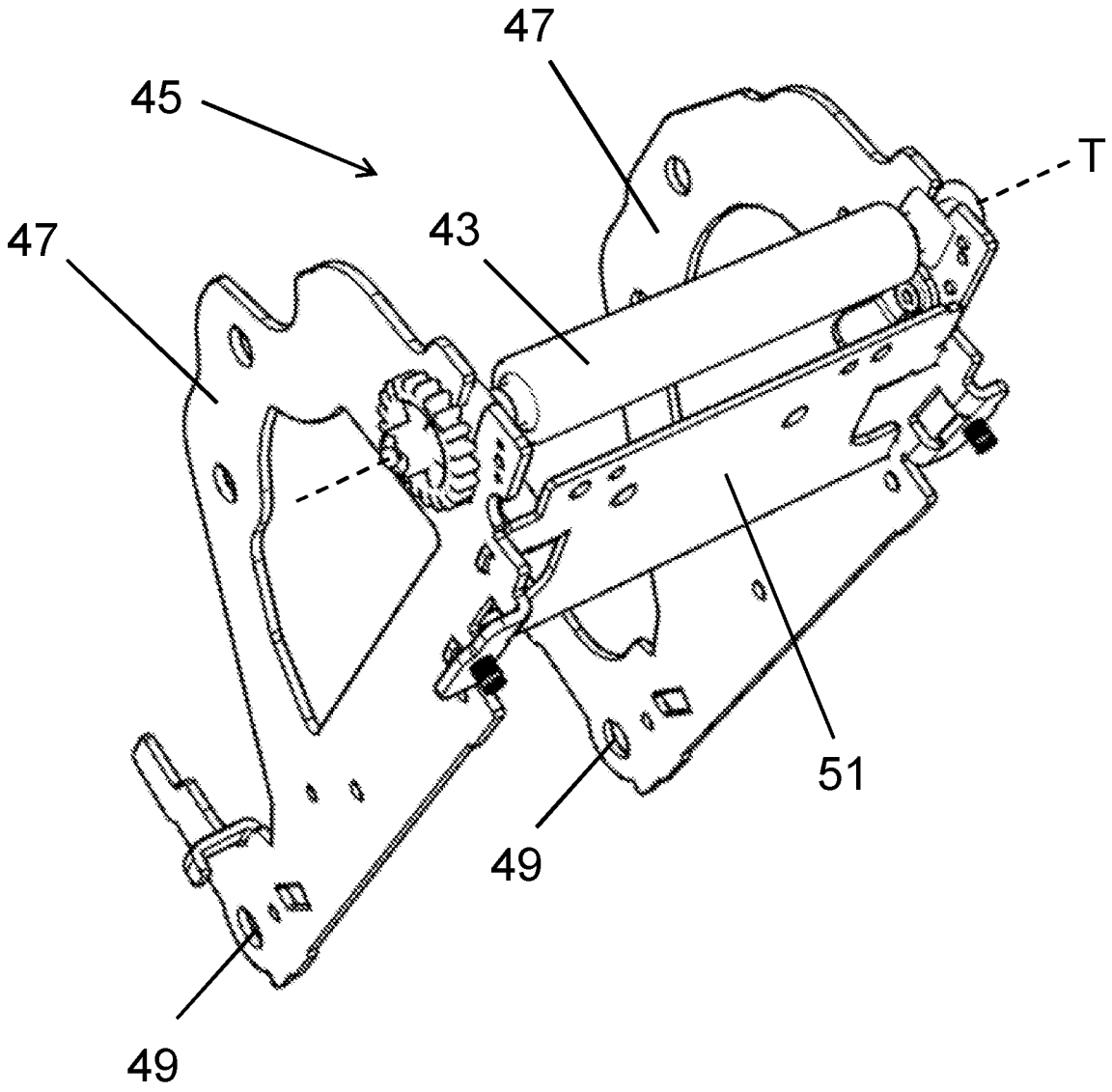
Figure 5:
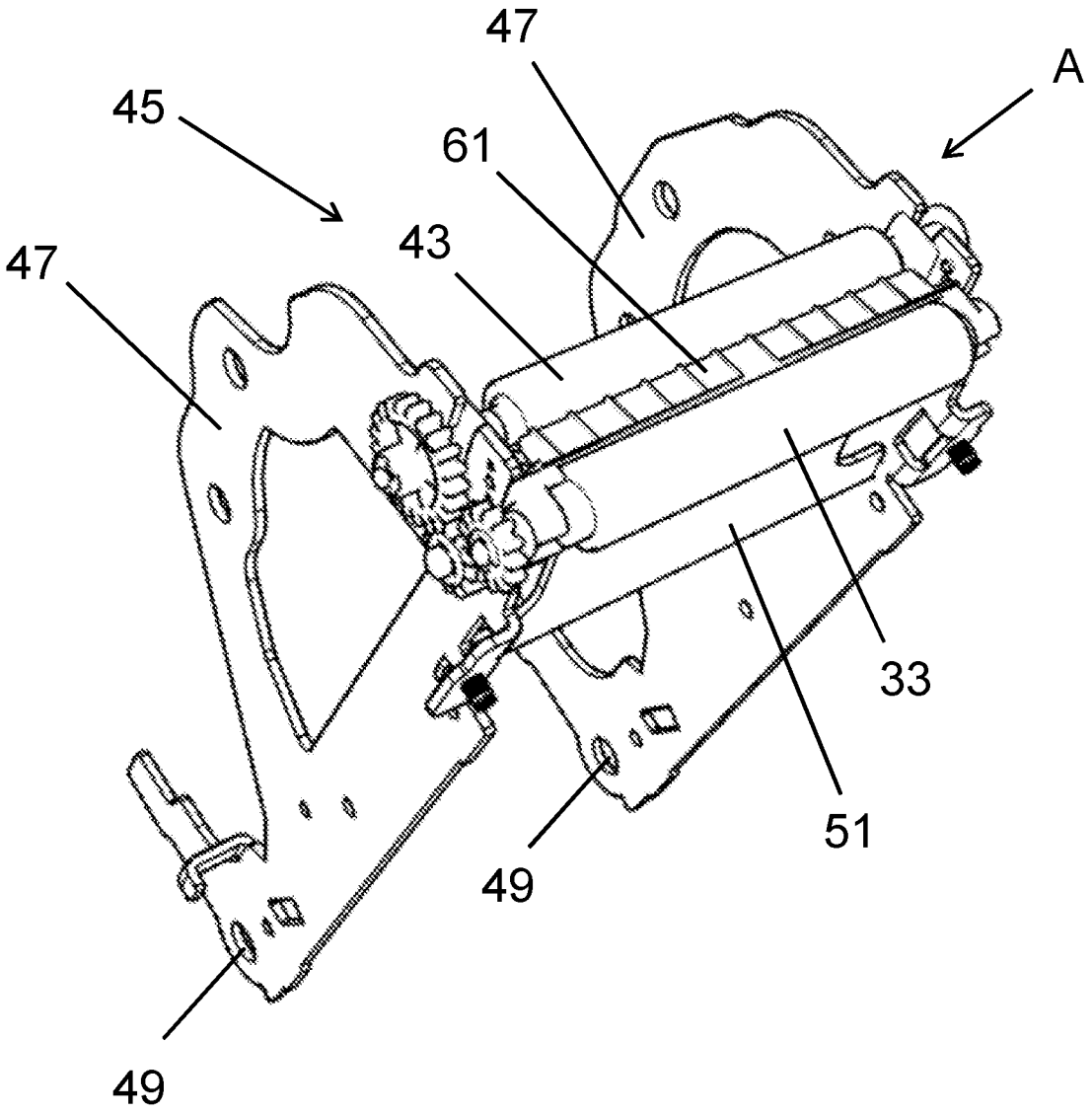
Figure 6:
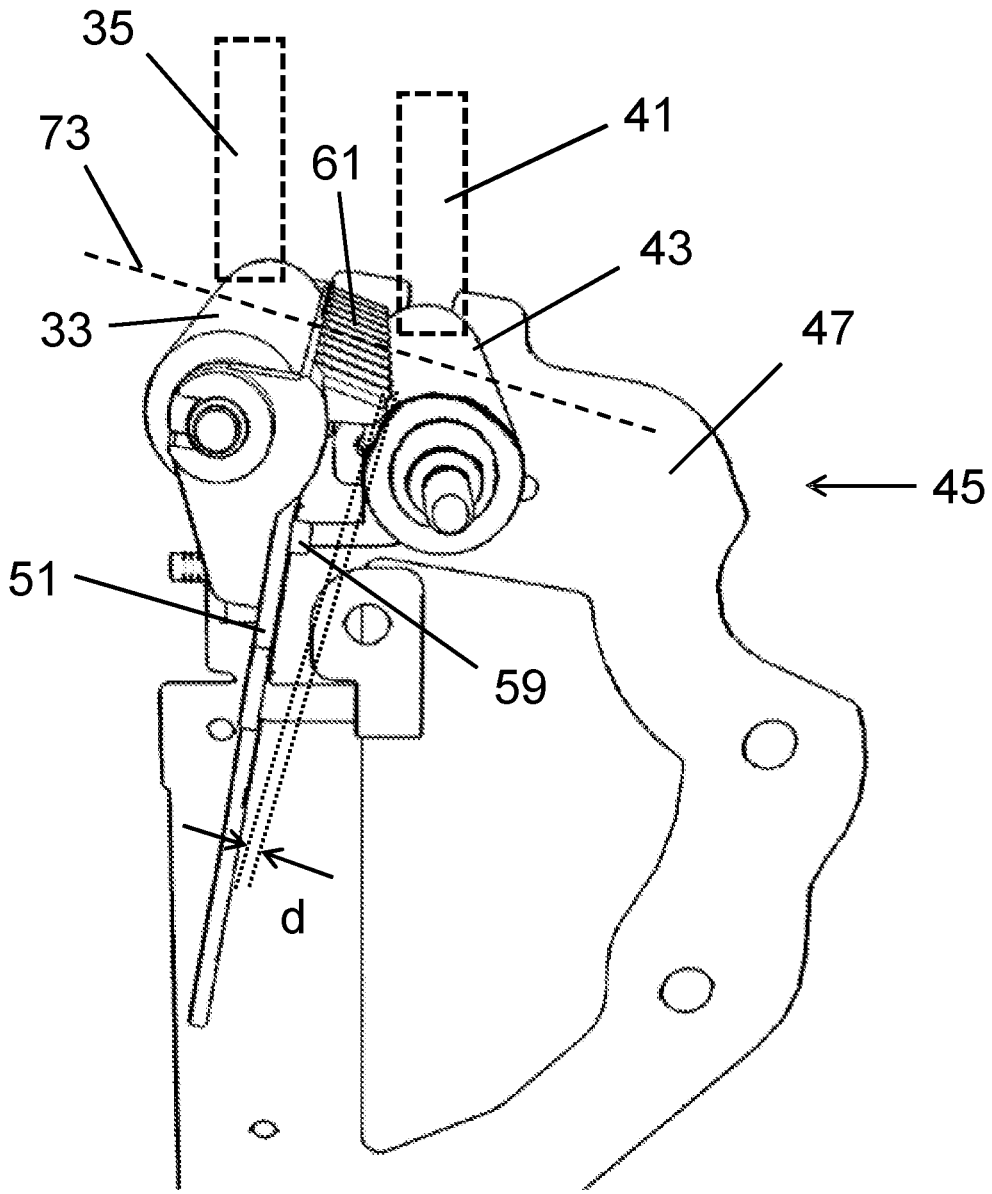
Figure 7:
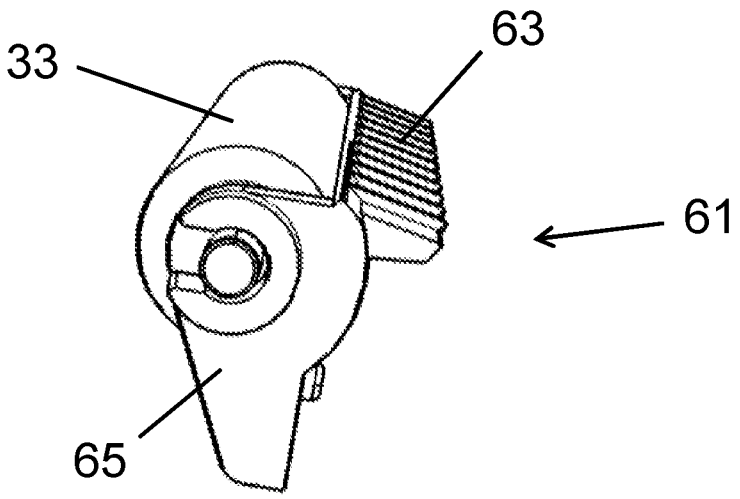
Figure 8:
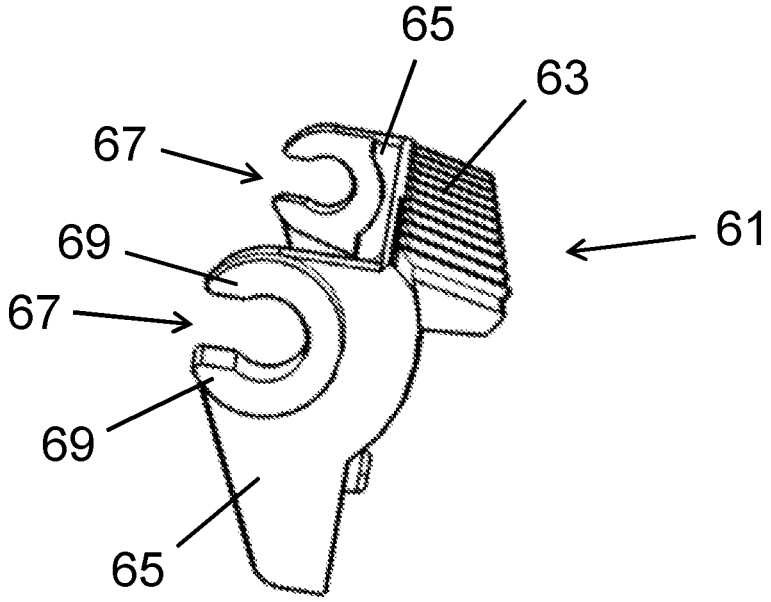
Figure 9:
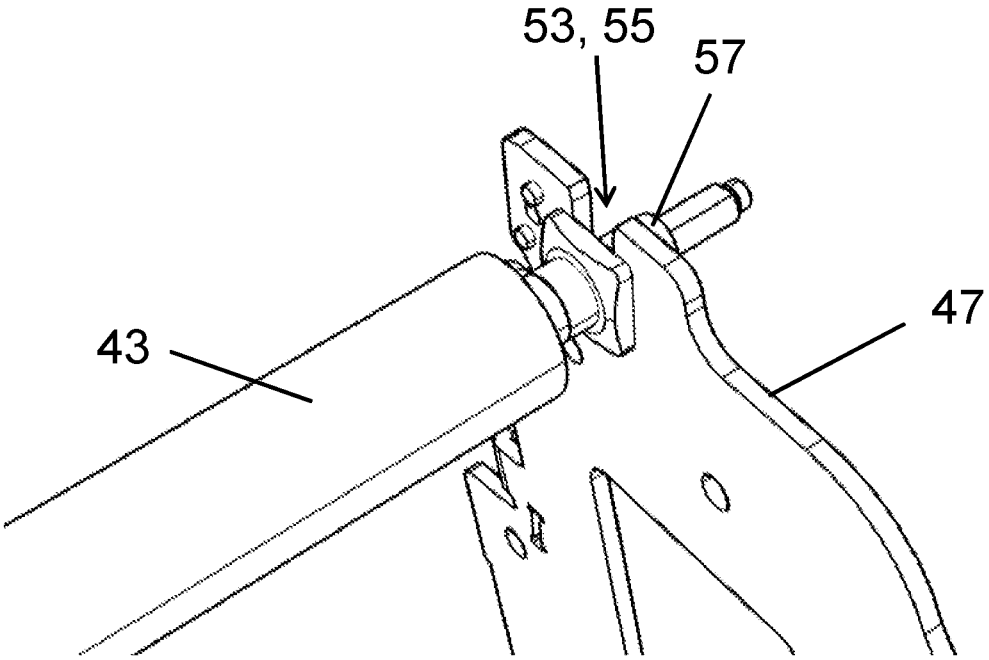
Figure 10:
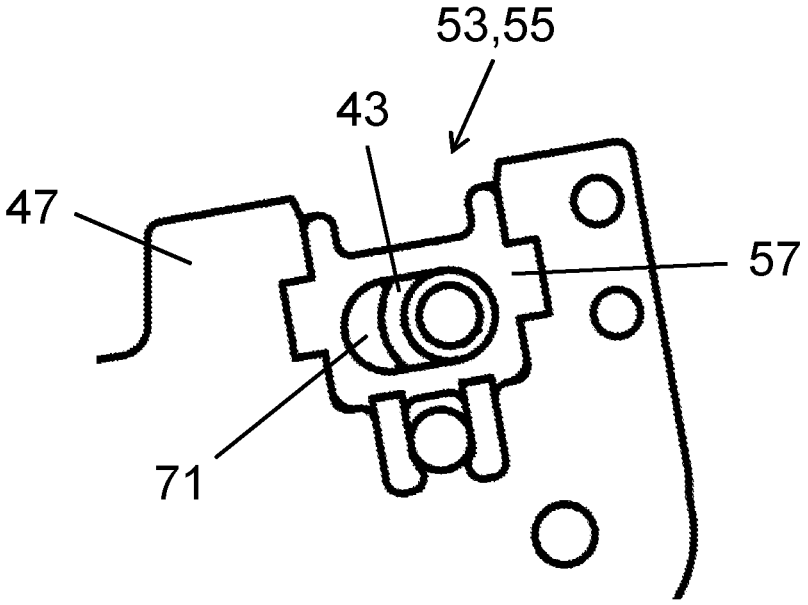

The invention will be described in the following by way of example with reference to the drawing. There are shown FIG. 1 a scale in accordance with the invention, in particular a store scale, comprising a label printer in accordance with the invention having a housing casing that is closed by a foldable housing element;

FIG. 2 the label printer in accordance with FIG. 1 in a front view in the region of a label output, wherein a front-side cover plate of the foldable housing element and a front-side cover section of the housing casing are omitted;

FIG. 3 a perspective view of a frame design of the foldable housing element having two side cheeks and a transverse strut in accordance with an embodiment of the invention;

FIG. 4 the frame design in accordance with FIG. 3 with a print roller;

FIG. 5 the frame design in accordance with FIG. 4 with the print roller, a stripping element, and a transport roller of a cutter;

FIG. 6 the frame design in accordance with FIG. 5 with the print roller, the stripping element, and the transport roller in a view from the direction A in accordance with FIG. 5, wherein one of the two side cheeks is omitted;

FIG. 7 the stripping element and the transport roller of FIG. 6 in an individual representation;

FIG. 8 the stripping element of FIG. 7 in an individual representation;

FIG. 9 a representation of the support of the print roller in accordance with FIG. 4 in one of the two side cheeks; and FIG. 10 a further embodiment of the invention.

The exemplary store scale 11 shown in FIG. 1 comprises a load plate 13 that determines the weight of an item disposed on it and that is displayed both on a display 15 for the customer and on a display 17 for the salesperson. The display 17 is configured as a touch screen such that the store scale 11 can also be operated via it. An identification number (PLU) associated with the respective item can be input via the touch screen 17 such that a price for the item can be calculated by adding the weight and the price is then likewise displayed on the two displays 15, 17. Furthermore, the store scale comprises a label printer 19 to print a label with the weight, the name of the item, and the calculated price.

The label printer 19 has a housing casing 21 that is open to the front, wherein this open side of the housing casing 21 can be closed by a housing element 23 that is attached to the housing casing 21 and that is foldable about a pivot axis D, with the closed position and thus the operating position of the foldable housing element 23 being shown in FIG. 1. The label printer 19 is operated with self-adhesive linerless endless tape labels. For this purpose, a receiver, not shown in the Figures, for a corresponding label roll on which the endless tape labels are wound is present in the interior of the label printer 19, wherein the label roll can be inserted into the receiver in the open position of the foldable housing element 23. The endless tape labels are fed along a predefined transport path in the label printer 19. After the printing of a respective label, said label is separated from the endless tape and is output at a label output 25 of the label printer 19.

FIG. 2 shows the label printer 19 in the region of the label output 25, wherein a front-side cover plate 27 of the foldable housing element 23 and a front-side cover section 29 of the housing casing 21 (cf. FIG. 1) are omitted such that the interior of the label printer 19 can be viewed in this region. As can be seen from FIG. 2, the label printer 19 has a cutter 31 by which the labels can be cut off from the endless tape.

Viewed in the transport direction of the endless tape labels, the cutter 32 is connected downstream of a printhead 41, which is only shown in FIG. 6 and is only shown schematically there, and of a print roller 43 (cf. FIGS. 4-6, 9 and 10) of the label printer 19, which is driven about an axis of rotation T, between which printhead 41 and print roller 43 the endless tape labels are led. The printhead 41 and the print roller 43 are arranged behind or below the cutter 31 in FIG. 2 and are thus not visible in FIG. 2.

In accordance with FIG. 2, the cutter 31 comprises a driven transport roller 33, which is rotatable about an axis of rotation R, for the endless tape labels. Furthermore, a blade unit 35 is provided that is travelable in a linear manner in parallel with an axis of rotation R of the transport roller 33. For this purpose, the blade unit 35 is configured as a spindle nut that is driven via a threaded rod 37, with which it forms a threaded spindle, in a travelable manner in both axial directions of the threaded rod 37 by an electric motor 39. The self-adhesive linerless endless tape labels are led between the transport roller 33 and the blade unit 35, wherein the transport roller 33 acts as a counter holder for the blade unit 35. In FIG. 6, the blade unit 35 is only schematically shown.

In this respect, the label printer 19 is designed such that the printhead 41 and the blade unit 35 are attached in the housing casing 21 and such that the print roller 43 and the transport roller 33 are attached to the foldable housing element 23, as can in particular be seen from FIGS. 5 and 6, in which a frame design 45 of the foldable housing element 23 (cf. FIG. 3) is shown together with the print roller 43 and the transport roller 33 that are each held at the frame design 45. The print roller 43 and the transport roller 33 are thus pivoted into the housing casing 21 on the closing of the foldable housing element 23 (cf. the closing direction S in FIG. 3) and thus only adopt their operating position in the closed position of the foldable housing element 23.

In accordance with FIG. 3, the frame design 45 of the foldable housing element 23 comprises two mutually oppositely disposed side cheeks 47 that, with their one end, are each connected in an articulated manner to a side wall of the housing casing 21, wherein the two pivot points 49 form the pivot axis D of the foldable housing element 23. The two side cheeks 47 extend into the housing casing 21 in the closed position of the housing element 23. Furthermore, the frame design 45 comprises a transverse strut 51 that connects the two side cheeks 47.

At their second ends, the two side cheeks 47 have a respective edge-side recess 53 into which the two axial ends of the print roller 43 are inserted, as in particular shown in FIG. 4. The two edge-side recesses 53 thus together form a receiver 55 for the print roller 43. The two axial ends of the print roller 43 are in this respect inserted into the two edge-side recesses 53 in an indirect manner via a respective bearing element 57 in the form of a bearing sleeve, as can be seen from FIG. 9. Furthermore, deflection rollers, not shown, for the transport path of the endless tape labels are present between the two side cheeks 47.

Furthermore, a stripping element 61 is provided that, viewed in the transport direction of the endless tape labels, is connected directly downstream of the print roller 43 and is connected directly upstream of the cutter 31, i.e. is arranged between the print roller 43 and the transport roller 33 of the cutter 31, as in particular shown in FIGS. 5 and 6. The stripping element 61 serves to strip off the self-adhesive linerless endless tape labels from the print roller 43 or to prevent an adhesion of the endless tape start to the print roller 43, in particular after a cutting off of a label and, if applicable, after a possible reversing of the endless tape labels.

The stripping element 61 is likewise attached to the foldable housing element 23 and is pivoted into the housing casing 21 on the closing of the foldable housing element 23. Specifically, the stripping element 61 is attached to the outside of the transverse strut 51 of the frame design 45 of the foldable housing element 23 via two screws 59, viewed in the closing direction S of the foldable housing element 23 (cf. FIGS. 2 and 6).

The stripping element 61 in this respect also serves as a holder and support of the transport roller 33 of the cutter 31 (cf. FIG. 7). For this purpose, the stripping element 61 also has two reception sections 65 for the transport roller 33 of the cutter 31 in addition to an elongated stripping section 63 whose longitudinal extent is oriented in parallel with the axis of rotation T of the print roller 43 and which satisfies the aforementioned stripping function. The two reception sections 65 have a respective edge-side recess 67 into which the two axial ends of the transport roller 33 are inserted (cf. FIG. 8). The two recesses 67 are bounded by two respective limbs 69 into which the two axial ends of the transport roller 33 are inserted. Subsequently, the axial ends of the transport roller 33 inserted into the two recesses 67 are secured in the reception sections 65 by a respective axially insertable bearing sleeve, not shown.

Furthermore, the stripping element 61 is arranged so close to the print roller 43 and the direction of removal of the print roller 43 from the print roller receiver 55 is oriented such that the print roller 43 is captively held in the print roller receiver 55 by the stripping element 61. In this respect, many variants that geometrically differ from one another are conceivable. The stripping element 61—viewed in a projection onto the label track 73—by way of example and preferably has an overlap d of 0.3 mm to 3 mm with the print roller 43 (cf. FIG. 6) and the removal direction of the print roller 43 from the print roller receiver 55 is oriented at approximately 70° with respect to the label track 73.

Despite the captive holding, the print roller 43 can nevertheless be easily removed from the print roller receiver 55 and replaced. For this purpose, the print roller 43 is produced from an elastically deformable material such as silicone and can therefore be forced past the stripping element 61 out of the print roller receiver 55. In this respect, the print roller 43 is deformed in an elastic and thus non-destructive manner. Analogously, the new print roller 43 can be forced into the print roller receiver 55. The replacement of the print roller 43 can therefore take place without tools.

Naturally, it is also possible that first the stripping element 61 is unscrewed from the transverse strut 51 and then the print roller 43—without still being held by the stripping element 61—is removed from the print roller receiver 55.

In FIG. 10, a further embodiment of the invention is shown in which the print roller 43 is supported via bearing elements 57, in particular bearing sleeves, in a print roller receiver 55, in particular in edge-side recesses 53, of the side cheeks 47 of the foldable housing element 23. In the two bearing elements 57, a respective elongate hole 71 extending perpendicular to the removal direction of the print roller 43 is provided, in which elongate holes 71 the two axial ends of the print roller 43 are displaceable between the operating position shown and a removal position. In the operating position, into which the print roller 43 is preloaded by means of a spring device that is not shown, the print roller 43 is captively held in the print roller receiver 55 by the stripping element 61 that is not shown in FIG. 10. In the removal position, the print roller 43 can be removed from the print roller receiver 55 past the stripping element 61 without contacting the stripping element 61.

REFERENCE NUMERAL LIST

11 store scale
13 load plate
15 customer display
17 operator touch screen
19 label printer
21 housing casing
23 foldable housing element
25 label output
27 front-side cover plate
29 front-side cover section
31 cutter
33 transport roller
35 blade unit
37 threaded rod
39 electric motor
41 printhead
43' print roller
45 frame design
47 side cheek
49 articulation point
51 transverse strut
53 edge-side recess
55 print roller receiver
57 bearing element
59 screw
61 stripping element
63 stripping section
65 reception section
67 edge-side recess
69 limb
71 elongate hole
73 label track
A direction
D pivot axis
d overlap
R axis of rotation
S closing direction
T axis of rotation

The invention claimed is:

1. A label printer for printing self-adhesive linerless endless tape labels, said label printer comprising a printhead and a driven print roller, wherein the endless tape labels can be led along a label track between the printhead and the print roller; and a stripping element for stripping off the labels from the print roller, said stripping element being connected downstream of the print roller in a transport direction of the endless tape labels, wherein the print roller is inserted into a print roller receiver of the label printer and is captively held in the print roller receiver by the stripping element.

2. The label printer in accordance with claim 1, wherein the label printer comprises a cutter for separating the endless tape labels, said cutter being connected downstream of the stripping element in the transport direction of the endless tape labels and comprising a transport roller and a blade unit travelable in a linear manner in parallel with an axis of rotation of the transport roller, with the endless tape labels being able to be led between the transport roller and the blade unit, and with the transport roller of the cutter being supported at the stripping element.

3. The label printer in accordance with claim 2, wherein the stripping element comprises an elongated stripping section whose longitudinal extent extends in parallel with the axis of rotation of the print roller and which, at its two ends disposed in the direction of the axis of rotation of the print roller, has a respective reception section, for the two axial ends of the transport roller of the cutter.

4. The label printer in accordance with claim 3, wherein the respective axial end of the transport roller is secured in the respective reception section of the stripping element by a respective axially inserted bearing sleeve.

5. The label printer in accordance with claim 3, wherein the respective reception section of the stripping element comprises a respective edge-side recess, and wherein the respective axial end of the transport roller is secured in the respective reception section of the stripping element.

6. The label printer in accordance with claim 1, wherein the label printer comprises a housing casing; and a foldable housing element that is attached to an open side of the housing casing and that can be folded about a pivot axis between a closed position and an open position, with the printhead being attached in the housing casing and the print roller and the stripping element being attached to the foldable housing element.

7. The label printer in accordance with claim 6, wherein the foldable housing element comprises two mutually oppositely disposed side cheeks which, with their respective first ends, are connected in an articulated manner to a respective side wall of the housing casing, which extend into the housing casing in the closed position of the foldable housing element, and wherein at their respective second ends, the print roller receiver is formed for the two axial ends of the print roller.

8. The label printer in accordance with claim 7, wherein the print roller is supported indirectly via a bearing element at each of its two axial ends in the print roller receiver.

9. The label printer in accordance with claim 8, wherein the bearing element is a bearing sleeve.

10. The label printer in accordance with claim 7, wherein the two side cheeks are connected to one another via a transverse strut, with the stripping element being attached to the transverse strut of the foldable housing element.

11. The label printer in accordance with claim 6, wherein the foldable housing element is a door.

12. The label printer in accordance with claim 1, wherein the print roller can be removed from the print roller receiver and inserted into the print roller receiver at an angle in the range from 60° to 120° with respect to the label track.

13. The label printer in accordance with claim 1, wherein the stripping element and the print roller have an overlap in a range from 0.3 mm to 3 mm, preferably from 0.3 mm to 2 mm, in a projection onto the label track.

14. The label printer in accordance with claim 1, wherein the print roller is produced from an elastically deformable material and can be forced in a non-destructive manner past the stripping element out of the print roller receiver and into the print roller receiver while forming an elastic deformation.

15. The label printer in accordance with claim 14, wherein the deformable material is a silicone.

16. The label printer in accordance with claim 1, wherein the print roller is displaceably supported between an operating position, in which the print roller is captively held in the print roller receiver by the stripping element and into which the print roller is preloaded by means of a spring device, and a removal position in which the print roller can be removed from the print roller receiver without resistance by the stripping element.

17. The label printer in accordance with claim 16, wherein the print roller is displacebly supported by means of an elongate hole arrangement and/or transversely to a removal direction of the print roller.

18. The label printer in accordance with claim 1, wherein the stripping element is releasably fastened in the label printer, with the print roller being removable from the print roller receiver without resistance by the stripping element after the release of the stripping element.

19. The label printer in accordance with claim 18, wherein the stripping element is releasably fastened in the label printer by unscrewing or screwing of the stripping element.

20. The label printer in accordance with claim 1, wherein the print roller can be removed from the print roller receiver and inserted into the print roller receiver without tools.

21. A scale comprising a label printer, wherein the label printer comprises:

a printhead and a driven print roller, wherein an endless tape labels can be led along a label track between the printhead and the print roller; and a stripping element for stripping off the labels from the print roller, said stripping element being connected downstream of the print roller in a transport direction of the endless tape labels, wherein the print roller is inserted into a print roller receiver of the label printer and is captively held in the print roller receiver by the stripping element.

* * * * *